United States Patent [19]

Fujita et al.

[11] Patent Number: 4,823,704

[45] Date of Patent: Apr. 25, 1989

[54] RAIL VEHICLE CONVEYING SYSTEM AND RAIL COVERS THEREFOR

[75] Inventors: Shigeyoshi Fujita, Suita; Tomoyuki Sasaki, Amagasaki; Kazuyoshi Fukuhara, Kashiwara; Hiroshi Nishikawa, Osaka, all of Japan

[73] Assignee: Daifuku Co., Ltd., Osaka, Japan

[21] Appl. No.: 87,103

[22] Filed: Aug. 14, 1987

Related U.S. Application Data

[63] Continuation of Ser. No. 730,276, May 3, 1985, abandoned.

[30] Foreign Application Priority Data

Jun. 18, 1984 [JP] Japan ..... 59-126182
Nov. 19, 1984 [JP] Japan ..... 59-244283

[51] Int. Cl.[4] ..... B62D 1/26; B63K 37/02

[52] U.S. Cl. ..... 104/247; 105/29.1; 238/135

[58] Field of Search ..... 104/106, 107, 140, 243, 104/244, 245, 246, 247, 242; 105/141, 144, 145, 291; 191/22 C, 30, 31; 238/135

[56] References Cited

U.S. PATENT DOCUMENTS

| | | | |
|---|---|---|---|
| 441,764 | 12/1890 | Jones | 191/30 |
| 2,728,819 | 9/1950 | Hauss | 191/30 |
| 3,159,110 | 12/1964 | Wylie | 104/246 |
| 3,434,705 | 3/1969 | Roder | 104/140 |
| 3,971,459 | 7/1976 | Becker et al. | 191/30 |
| 4,043,436 | 8/1977 | Segar et al. | 191/226 |
| 4,207,821 | 6/1980 | Beckert | 104/106 |
| 4,467,726 | 8/1984 | Aldous et al. | 104/246 |
| 4,505,205 | 3/1985 | Huang et al. | 104/139 |

FOREIGN PATENT DOCUMENTS

| | | | |
|---|---|---|---|
| 1367556 | 6/1964 | France | 104/106 |
| 472871 | 9/1975 | U.S.S.R. | 104/107 |
| 2008 | of 1900 | United Kingdom | 104/245 |
| 4542 | of 1908 | United Kingdom | 104/247 |
| 381748 | 10/1932 | United Kingdom | 104/247 |
| 685119 | 12/1952 | United Kingdom | 104/247 |

*Primary Examiner*—Robert B. Reeves
*Assistant Examiner*—Joseph D. Pape
*Attorney, Agent, or Firm*—Webb, Burden, Ziesenheim & Webb

[57] ABSTRACT

A conveying system having a cart traveling on a rail. A rail cover strut is disposed along the rail and a rail cover is attached to the rail cover strut. A wheel or wheels of the cart are mounted on a bracket extending to pass under the lower end of the rail cover.

8 Claims, 6 Drawing Sheets

RAIL VEHICLE CONVEYING SYSTEM AND RAIL COVERS THEREFOR

This application is a continuation of application Ser. No. 06/730,276, filed May 3, 1985, now abandoned.

BACKGROUND OF THE INVENTION

This invention relates to a conveying system for conveying mainly articles in a factory, a warehouse or the like.

A known conveying system particularly such a conveying system utilizing electromotive carts, comprises a rail cover which covers rails for guiding the electromotive carts, electric conductor rails and other components. This cover is installed on a floor along a conveying route and has a gate-shaped section. The rails are defined inside lateral walls of the gate-shaped rail cover. According to this construction, wheels rotatable along the rails, a drive mechanism including an electric motor, an electric current collector and other devices mounted on the electromotive carts are movable within a space covered by the rail cover.

Such a known conveying system is disclosed, for example, in the U.S. Pat. No. 4,207,821.

In the known conveying system as described above, the rail cover and rail cover struts provided along mid-positions of the rail cover receive all weights acting on the rails, which weights consists of weights of the electromotive carts per se and loads carried by the carts. Therefore, the rail cover and the struts must be a very heavy construction having sufficient strength which is very costly compared with a conveying system having no such cover. In other words, this known conveying system is not suited for conveying heavy articles.

Furthermore, since the rail cover acts also as means to support the rails, it is impossible to remove only the cover at a certain selected position to do maintenance work on the rails, the electric conductor rails or the electromotive carts. The prior art construction also has the disadvantage that only a limited range of choice is available for the sectional shape of the rails supporting the electromotive carts.

SUMMARY OF THE INVENTION

The object of the invention is to eliminate the disadvantages of the prior art noted above.

In order to achieve this object a conveying system according to this invention comprises at least one rail supported substantially on a floor, at least one rail cover strut disposed along the rail, at least one rail cover covering a space above the rail, said cover being supported by the rail cover strut, and a cart travelling on the rail, wherein the cart is provided with at least one bracket extending the downwardly and a lower end of the bracket passes under a lower end of the rail cover and extends into the space and provides a wheel.

In the above construction according to this invention, the rail cover means protects the rail from obstacles. Further, this means protects the wheel rotatable on the rail and then prevents foreign matters from becoming caught in the system, sprinkle of water and the like, and powdery dust developed in the cart from scattering out of the system. The conveying system of this invention provides a great improvement in safety aspect since workers operating adjacent the conveying route are free from the danger of becoming caught by the wheel.

Further, the rail supporting the car is disposed on the floor independently of the rail cover means. This feature permits the rail to have any suitable sectional profile and to have increased strength and rigidity as necessary.

On the other hand, the rail cover means may be formed of thin plates since the rail cover means do not receive the weight of the electromotive cart or the loads carried thereby. The rail cover strut may have sufficient strength just to support the rail cover means. Thus, the cost of the rail cover means and the components associated therewith is much smaller than the case of the prior art.

Moreover, the construction of this invention permits the rail cover means to be removed independently of the rail to facilitate maintenance of the electromotive cart and the rail at a position from which the rail cover means is removed. It is also possible to remove one or more of the electromotive carts from the system as necessary.

Other advantages of this invention will be apparent from the following description.

BRIEF DESCRIPTION OF THE DRAWINGS

The drawings illustrates a conveying system according to this invention, in which.

DESCRIPTION OF THE PREFERRED EMBODIMENTS

Figure 1:
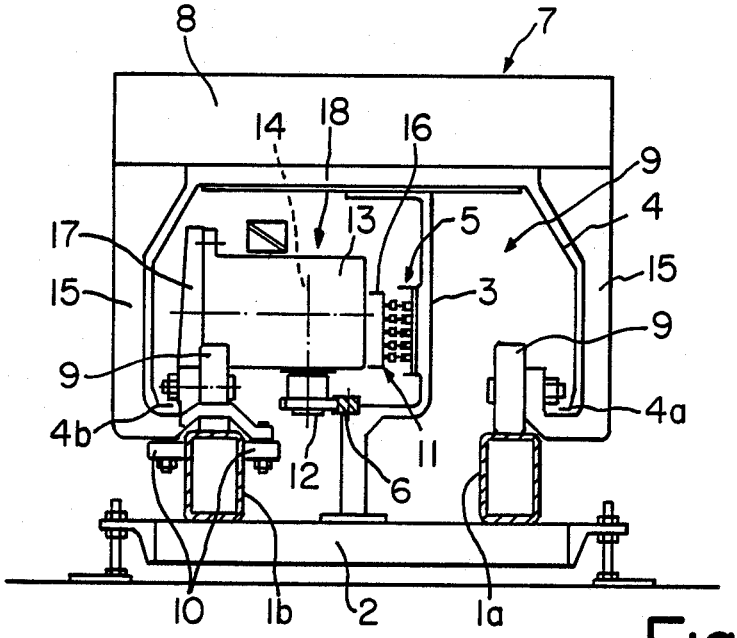
FIG. 1 is a front view in vertical section of the conveying system.
Figure 2:
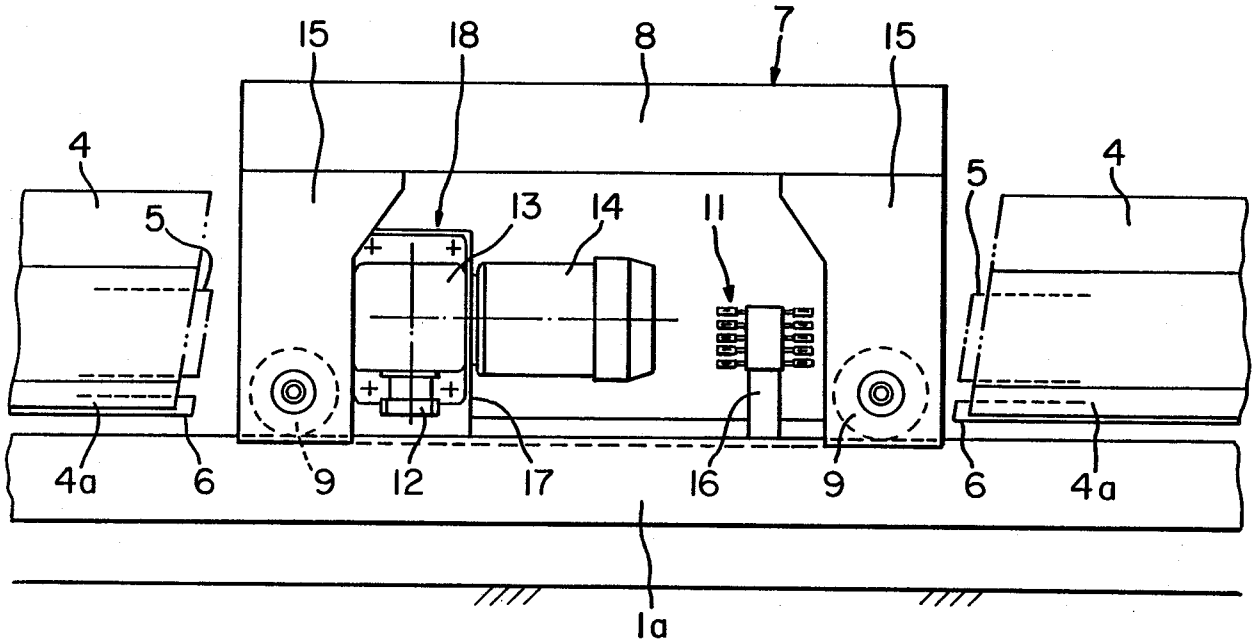
FIG. 2 is a partly broken away side view of the system.

As shown in FIGS. 1 and 2, a conveying system according to this invention comprises a pair of right and left rails 1*a* and 1*b* laid along a conveying route and supported by a floor by a means of rail supports 2 arranged at suitable intervals along the conveying route. Number 3 denotes rail cover struts disposed between the rails 1*a* and 1*b* and extending upwardly from the rail supports 2. The rails 1*a* and 1*b* and the rail cover struts 3 may be fixed directly to the floor without using the rail supports 2. Number 4 denotes rail covers having a gate-shaped section and supported at inner mid-positions thereof by the rail cover struts 3. The rail covers 4 have lower ends 4*a* and 4*b* of lateral sides thereof opposed to and outwardly and upwardly spaced from the rails 1*a* and 1*b*, respectively. These rail covers 4 may comprise a plurality of cover units each having an appropriate length and removably attached to each of the rail cover struts 3, so that the cover units in combination form a continuous rail covering extending along the conveying route. The rails may have a height less than a lower end of the lateral sides of the rail covers. According to this construction, the rail covers 4 may be removed over any selected length from any selected positions of the conveying route. Number 5 denote electric conductor rails fixed on lateral faces of the rail cover struts 3. Number 6 denotes a rack fixed to the lateral faces of the rail cover struts 3 below the electric conductor rails 5 and extending horizontally along the conveying route.

Number 7 denotes one of the electromotive carts. Each cart 7 comprises a carrier bed 8 located directly over the rail covers 4, support wheels 9 rotatable on horizontal axes and along top faces of the rails 1*a* and 1*b*, centering rollers 10 rotatable on vertical axes and disposed on opposite sides of one of the rails 1*b*, an electric current collector 11 in sliding contact with the electric conductor rails 5, a drive pinion 12 in mesh with the rack 6, and an electric motor 14 adapted to drive the pinion 12 through a reduction mechanism 13.

Brackets 15 depend from four corners of the carrier bed 8 and extend into the rail covers 4 through spaces between the rails 1*a* and 1*b* and the lower ends 4*a* and 4*b* of the lateral sides of the rail covers 4. The wheels 9 are rotatably supported by free ends of the brackets 15 inside the rail cover 4, respectively. The centering rollers 10 are rotatably supported by the free ends of front and back brackets 15 on one lateral side of the carrier bed 8. The electric current collector 11 and the reduction mechanism 13 are mounted on free ends of brackets 16 and 17 which, as do the brackets 15, depend from the carrier bed 8 and extend into the rail covers 4 through the spaces between the rail 1*b* and the lower ends 4*b* of the lateral sides of the rail covers 4. The electric motor 14 is supported by the reduction mechanism 13. Thus, drive means 18 comprising the pinion 12, reduction mechanism 13 and electric motor 14, the wheels 9 and the electric current collector 11 mounted on the electromotive carts 7 are all disposed in spaces 19 covered by the rail covers 4. Stationary components such as the electric conductor rails 5 and the rack 6 are also disposed in these spaces 19. The centering rollers 10 are disposed directly below the spaces 19.

In the described conveying system, the electric motor 14 of each electromotive cart 7 is driven by power and control signals supplied thereto from the electric conductor rails 5 through the electric current collector 11. The electric motor 14 provides torque output to rotate the pinion 12 thereby causing the cart 7 to run in a desired direction along the rails 1*a*,1*b*. As a result articles are conveyed as mounted on the carrier bed 8. When the electromotive cart 7 is running, the drive means 18, wheels 9 and the electric current collector 11 move within the spaces 19 convered by the rail covers 4.

In the described embodiment, the drive means 18 including the electric motor 14 comprises the pinion 12 in mesh with the stationary rack 6. Alternatively, the drive means may comprise one of the support wheels 9 or an additional drive wheel driven by the electric motor 14. Furthermore, the centering rollers 10 arranged in two pairs, one in the front and the other in the back of the cart 7, to be engageable with opposite sides of one of the rails 1*b* may be replaced with a pair of right and left rollers engageable with inner or outer lateral faces of the two rails 1*a* and 1*b*, respectively. It is of course possible to dispense with the centering rollers by arranging that the support wheels 9 are in mesh with at least one of the rails 1*a* and 1*b*.

Figure 3:
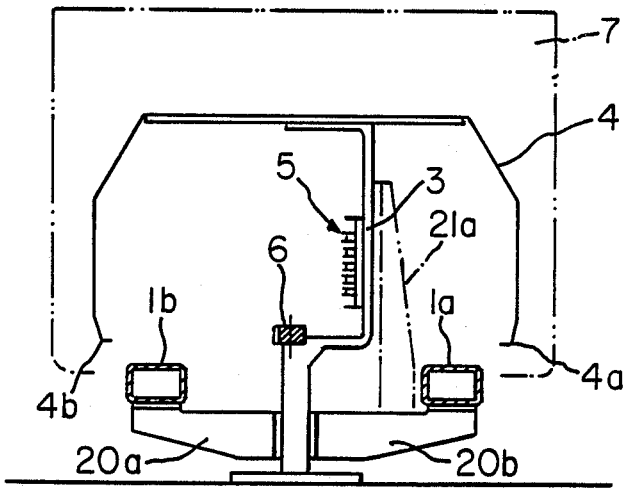
FIG. 3 is a front view in vertical section of a modified example.

Instead of providing the two independent rails 1*a* and 1*b*, one broad rail-forming member may be provided to define two rails, which are integral with each other, on respective lateral sides thereof. This construction will enable the two rails 1*a* and 1*b* to be laid with ease and with high precision. On the other hand, as shown in FIG. 3, the rails 1*a* and 1*b* may be supported by rail cover struts 3 upstanding from the floor, by means of rail supporting brackets 20*a* and 20*b* or 21*a* attached to the struts 3. Instead of the arrangement shown in FIG. 3, rail struts may be provided for exclusively supporting the guide rails 1*a* and 1*b*.

FIGS. 4 through 7 show a further embodiment of the invention. This embodiment differs from the preceding embodiment mainly in that a pair of right and left rails 101*a* and 101*b* have a T-shaped section and that rail covers struts 103 are disposed closer to one of the rails 101*a* and 101*b* than to the other.

Figure 4:
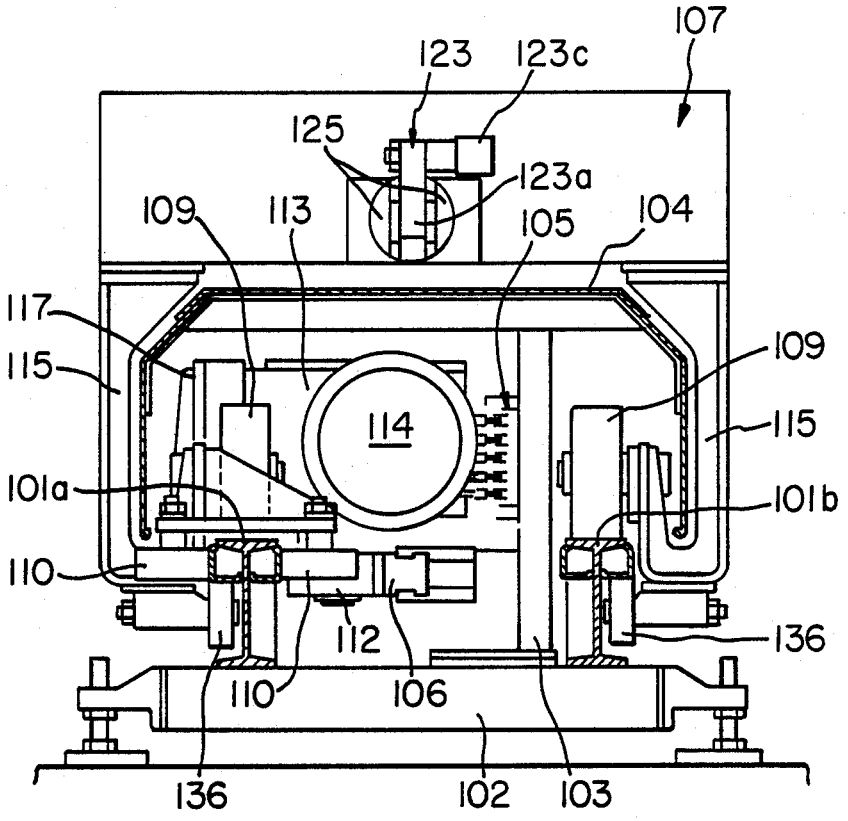
FIG. 4 is a front view in vertical section of the conveying system according to a further embodiment.
Figure 5:
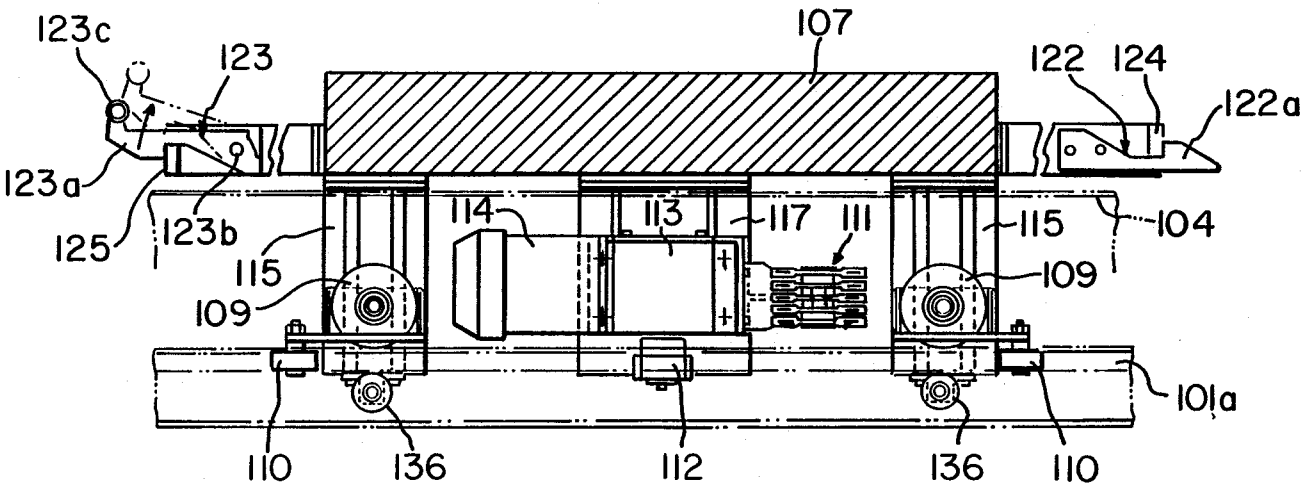
FIG. 5 is a partly broken away side view of the system shown in FIG. 4.

Referring to FIGS. 4 and 5, the conveying system according to this embodiment comprises electromotive carts 107, the right and left rails 101*a* and 101*b*, a rack 106 disposed between the rails 101*a* and 101*b*, and a rail unit 105 for transmitting power and control signals. Number 104 denotes rail covers having an arch-shaped section and supported through rail cover struts 103 by support frames 102 which is also support the two rails 101*a* and 101*b*. The rail covers 104 cover the rails 101*a* and 101*b*, the rack 106, and the power and control signal transmitting rail unit 105. The rail cover struts 103 also support the rack 106 and the rail unit 105.

Each of the electromotive carts 107 includes brackets 115 arranged at four corners thereof and extending into a space inside the rail covers 104 through spaces between the rails 101*a* and 101*b* and lower ends of the rail cover 104. Each of the brackets 115 carries a support wheel 109 rotatable on a horizontal axis and an anti-lift roller 136 rotatable on a horizontal axis, the wheel 109 and the roller 136 being vertically opposed to each other across the rail 101*a* or 101*b*. Front and back brackets 115 on one lateral side of the cart 107 further carries centering rollers 110 rotatable on vertical axes and horizontally opposed to each other across one of the rails 101*a*. Number 117 denotes a drive means supporting bracket similar to the brackets 115 and attached to an intermediate position on the lateral side of the cart 107, the bracket 117 supporting a motor 114, a reduction mechanism 113 and an electric current collector 111. The reduction mechanism 113 includes a vertical output shaft carrying a pinion 112 in mesh with the rack 106. The motor 114 is driven by the power and control signals supplied by the rail unit 105 through an electric current collector 111.

The electromotive cart 107 carries a stationary coupling device 122 projecting from one of the longitudinal ends thereof, and a movable coupling device 123 projecting from the other longitudinal end thereof. The stationary coupling device 122 includes an upwardly protruding sawtooth-shaped catch 122*a*. The movable coupling device 123 is upwardly pivotably attached to a pin 123*b* and includes a downwardly protruding sawtooth-shaped catch 123*a* and a cam follower roller 123*c* projecting sideways from an extreme end thereof. The two catches 122*a* and 123*a* are in opposite relationship in the longitudinal direction of the cart 107. Numbers 124 and 125 denote spacers disposed on opposite lateral sides of the stationary coupling device 122 and the movable coupling device 123, respectively, to maintain the carts 107 in mutually spaced relationship.

The electromotive cart 107 having the described construction is movable backward and forward along the rails 101*a* and 101*b* by actuating the motor 114 to drive the pinion 112 backward and forward. The cart 107 may automatically be stopped at a predetermined position and may automatically be started in response to a start signal. It is of course possible to automatically switch its traveling speed between predetermined high and low speeds.

Figure 6:
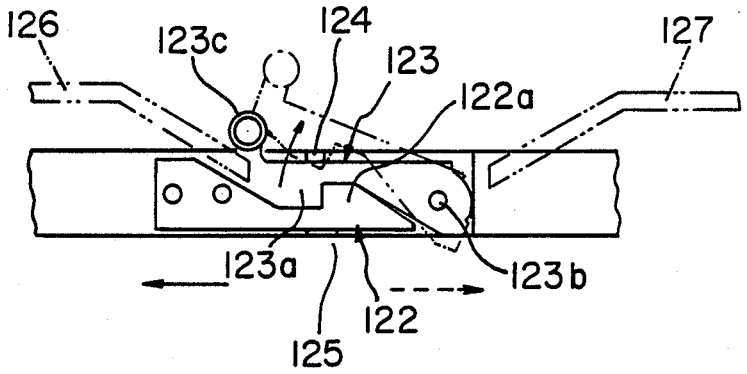
FIG. 6 is a side view in vertical section showing coupling means in an engaged position.

When one of the carts 107 approaches within a certain distance from another cart 107 running slowly or standing still, the spacers 124 and 125 abut against each other no matter whether one or both of the carts 107 is/are moving backward or forward. At this time, as shown in FIG. 6, the movable coupling device 123 mounts the stationary coupling device 122 and the two sawtooth-shaped catches 122*a* and 123*a* automatically clank into engagement. The cart 107 that has overtaken the other cart 107 is then slowed down to the speed of the other cart 107 or stopped if the latter is standing still, whereby the two carts 107 travel at the slow speed or stand still in the coupled state. The cart 107 that has overtaken the other may automatically be controlled, for example, in response to detection signals from a detector provided for detecting the coupling engagement between the two coupling devices 122 and 123.

For uncoupling the two carts 107 running in the coupled state at the slow speed, a cam 126 or 127 as shown by phantom lines in FIG. 6, whichever is fit for a direction in which the carts 107 are running, is moved, for example, from a position off the conveying route into a path of the cam follower roller 123*c* of the movable coupling device 123 between the two carts 107. This causes the cam follower roller 123*c* to run onto the cam 126 or 127, whereby the movable coupling device 123 pivots upwardly about the pin 123*b* and disengages from the stationary coupling device 122. Then, the cart 107 running ahead of the other cart 107 is switched into the high speed to depart from the other cart 107. The cam 126 or 127 is retracted to the position off the conveying route before the other cart 107 running at the slow speed hits the cam 126 or 127.

Figure 7:
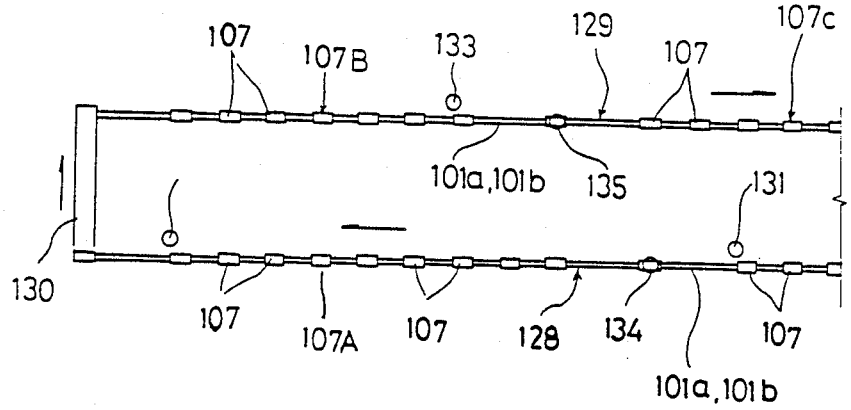
FIG. 7 is a plan view of a layout example of the conveying system.

FIG. 7 shows a layout example of the conveying system utilizing the described automotive carts 107. Number 128 denotes a forward-going track. Number 129 denotes a return track. Number 130 denotes a traverser. Numbers 131 through 133 denote uncoupling devices including the above-described cams 126 and 127 and means to project and retract the cams. Numbers 134 and 135 denote cart clamping devices for clamping the carts 107 at predetermined positions.

According to this conveying system, the carts 107 uncoupled from following carts 107 running at the slow speed by the uncoupling devices 131–133 may be driven at the high speed until they reach the cart clamping devices 134 and 135 or until they reach the traverser 130 which transfers the carts 107 from the forward-going track 128 to the return track 129, the carts 107 again being driven at the high speed along the return track 129. The carts 107 reaching the cart clamping devices 134 and 135 are automatically stopped and fixed in the predetermined positions by the clamping devices 134 and 135 whereby, for example, work carried by the carts 107 are fitted with parts by automatic machines installed off the tracks 128 and 129.

The carts 107 running at high speed from the cart clamping devices 134 and 135 and the cart 107 entering the return track 134 at high speed from the traverser 130 are automatically coupled by the described coupling devices 122 and 123 to the rearmost carts 107 in rows 107A–107C of carts 107 linked together by the coupling devices 122 and 123 and advancing slowly toward the uncoupling devices 131–133, respectively. Upon coupling to the rearmost carts 107 in the rows 107A–107C the overtaking carts 107 are switched to the slow speed and incorporated into the rows 107A–107C. Varied assembly operations are carried out on the work carried by the carts 107 in the slowly advancing rows 107A–107C. In other words, track portions upstream of the uncoupling devices 131–133 are utilized as continuous operation lines where the plurality of automotive carts 107 linked together by the coupling devices move one after another at the slow speed. Track portions downstream of the uncoupling devices 131–133 are utilized as high speed intermittent flow lines where the separated carts 107 run at the high speed.

While in the foregoing embodiment the coupling devices are automatically engageable by one of the carts approaching another, the coupling devices may comprise the type operable by means installed at positions of the running track where the carts should be coupled together. Furthermore, the carts may be equipped with drive means to switch the coupling devices between engaged and disengaged positions, the drive means being automatically operable by remote control, i.e. by transmitting control signals to the carts to operate the drive means and place the coupling devices into and out of engagement with each other.

Figure 8:
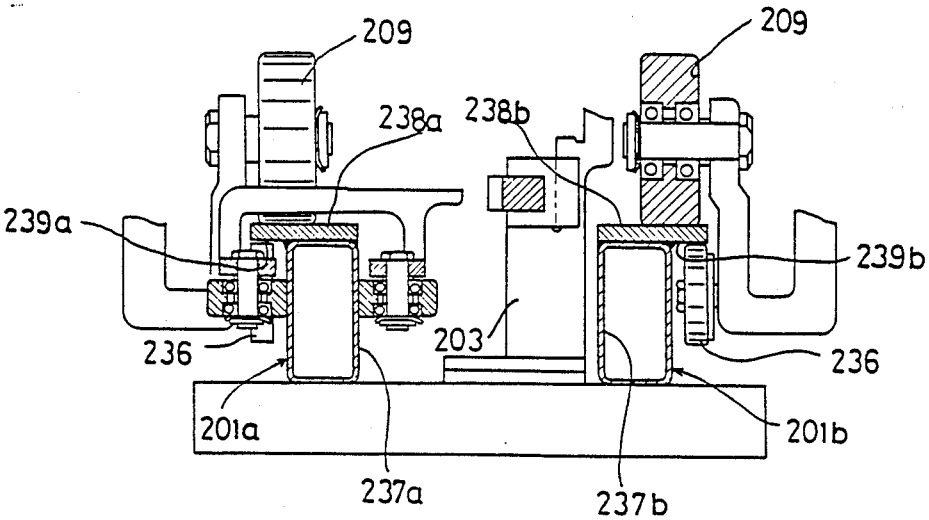
FIG. 8 is a front view partly in section of a modified rail construction.

FIG. 8 is a front view in vertical section showing a modified rail structure which, as distinct from the preceding embodiment, comprises guide rails 201*a* and 201*b*, each consisting of main portions 237*a* and 237*b* and a board member 238*a* and 238*b* welded to an upper face of the main portions 201*a* and 201*b*. Each of the board members 238*a* and 238*b* is projecting laterally outwardly of the main portion 201*a* or 201*b*, and an undersurface 239*a* or 239*b* of its projecting portion is contacted by guide rollers 236 for preventing vertical swinging of the electromotive carts. Support wheels 209 are disposed relative to the rails 201*a* and 201*b* such that support wheels 209 rotate along the rails 201*a* and 201*b* slightly outwardly displaced from positions right above the main portions 237*a* and 237*b* located below.

Figure 9:
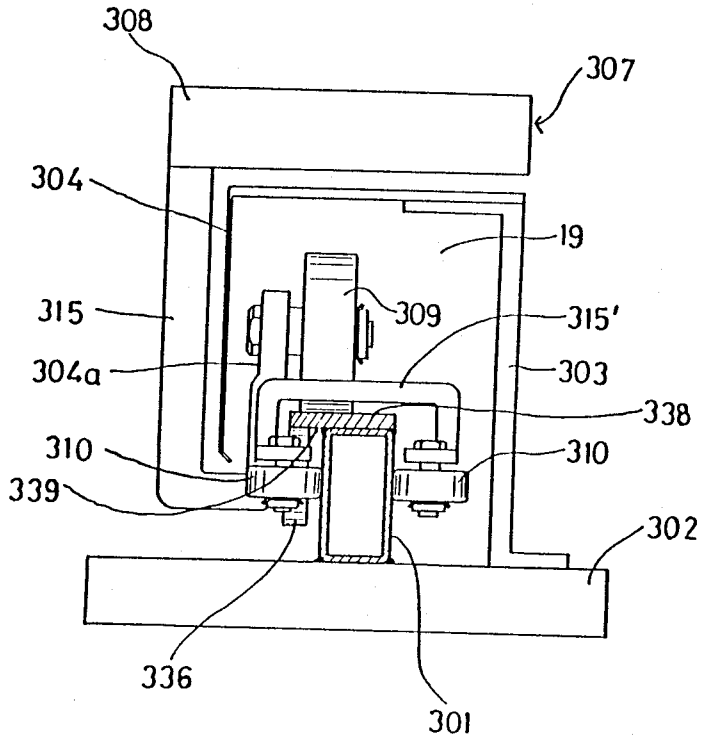
FIG. 9 is a front view partly in section of a mono-rail cart conveying system which is provided with no driving means.

FIG. 9 shows another embodiment of this invention in which this invention applies for a mono-rail cart which is provided with no driving means. A cart 307 having a carrier bed 308, does not have driving means contrary to the above embodiments and may travel by utilizing gravity and the force of inertia. A mono-rail 301 is mounted on a rail support 302. A rail cover strut 303 is disposed along the rail cover strut 303 to form a space 309 above the rail 301. A lower end 304*a* of the rail cover 304 is constructed to extend downwardly beyond the upper surface of the rail 301. A board member 338 is welded to the upper surface of the rail 301 along the rail 301. The board member 338 projects toward the side opposite to the rail cover strut 303 and is provided with an undersurface 339. The cart 307 is provided with brackets 315 extending downwardly. Each of the lower ends passes under the lower end 304*a* of the rail cover 304 and extends into the space 319. Wheels 309 rotatably mounted respectively on the lower ends 304*a* to be positioned on the board member 338. A bracket of U-shape 315' is attached to the lower ends 304*a*, respectively, and at each end of the brackets 315' a vertical axis roller 310 is mounted rotatably to contact each of the side walls of the rail 301. Also, at the lower ends 304*a* a lateral axis roller 336 is mounted rotatably to contact the undersurface 339. The vertical and lateral axis rollers 310 and 336 prevent vertical and lateral oscillations of the cart 307.

Driving means as shown in the above-mentioned embodiments may be provided with the above cart of mono-rail type.

What is claimed is:

1. A conveying system comprising:

(a) a pair of spaced rails supported substantially on a floor face and fixedly secured to rail supports along a conveying route, with an upper face of each rail being substantially horizontal for mounting wheels thereon;

(b) a plurality of rail cover struts spaced apart from each other and positioned along said conveying route between said rails, with each of said rail covers struts supported by said rail supports and extending upwardly therefrom;

(c) a plurality of rail covers positioned above and outwardly spaced from said rails, said rail covers having a transverse dimension greater than the distance between said rails, said rail covers forming a continuous rail covering extending along the conveying route, with each of said rail covers having a middle portion attached to and supported by one or more of said rail cover struts and having a pair of lateral sides extending downwardly from said middle portion, and with said rails having a height less than a lower end of said lateral sides of said rail covers; and (d) a cart travelling on said rails, said cart having a carrier bed located above said rail covers and including at least two brackets extending downwardly from said carrier bed along opposed sides thereof and outside of said lateral sides of said rail covers, with a lower end of each bracket having a wheel rotatably mounted thereto, with the lower end of each bracket extending beneath the lateral sides of said rail covers between the rail covers and the rails such that the brackets ride on the upper face of an associated rail by said wheels.

2. The conveying system of claim 1 further including a pair of vertical axis rollers for centering, said rollers being attached to at least one of said brackets in such a way as to bind at least one of said rails from both sides thereof.

3. The conveying system of claim 1 further including a rack gear attached to the rail cover struts, an electric motor operatively connected to one of said brackets, a pinion gear operatively connected to the electric motor to mesh with the rack gear, electric current collecting means attached to the bracket, and electric conductor rail means attached to the rail cover struts.

4. The conveying system of claim 1 wherein said rails are formed in a T-letter shaped section and said system further includes at least one horizontal axis roller for anti-lift mounted rotatably on said brackets to contact the undersurface of said T-letter shaped section rails.

5. The conveying system of claim 2 wherein said rails are formed in a T-letter shaped section and said system further includes at least one horizontal axis roller for anti-lift mounted rotatably on said brackets to contact the undersurface of said T-letter shaped section rails.

6. The conveying system of claim 1 wherein at least one of said rails has an outwardly projecting section and further includes an anti-lift means mounted rotatably on at least one of said brackets to contact an undersurface of said outwardly projecting section of said rails.

7. The conveying system of claim 6 further including a rack gear attached to the rail cover struts, an electric motor operatively connected to one of said brackets, a pinion gear operatively connected to the electric motor to mesh with the rack gear, electric current collecting means attached to the bracket, and electric conductor rail means attached to the rail cover struts.

8. The conveying system of claim 7 further including at least one vertical axis roller for centering, said roller being attached to the bracket.

* * * * *